US012234999B2

(12) United States Patent
Gray et al.

(10) Patent No.: US 12,234,999 B2
(45) Date of Patent: Feb. 25, 2025

(54) WINDOW-MOUNTED AIR CONDITIONER

(71) Applicant: Midea Group Co., Ltd., Foshan (CN)

(72) Inventors: Joel M. Gray, Prospect, KY (US); Wyman Mastin, Louisville, KY (US)

(73) Assignee: MIDEA GROUP CO., LTD., Guangdong (CN)

( * ) Notice: Subject to any disclaimer, the term of this patent is extended or adjusted under 35 U.S.C. 154(b) by 166 days.

(21) Appl. No.: 17/685,336

(22) Filed: Mar. 2, 2022

(65) Prior Publication Data

US 2023/0280048 A1 Sep. 7, 2023

(51) Int. Cl.
*F24F 1/031* (2019.01)
*F24F 1/029* (2019.01)
*F24F 13/20* (2006.01)

(52) U.S. Cl.
CPC ..... *F24F 1/031* (2019.02); *F24F 1/029* (2019.02); *F24F 13/20* (2013.01)

(58) Field of Classification Search
CPC .... F24F 1/03; F24F 1/027; F24F 1/029; F24F 1/031; F24F 13/20; F24F 2221/20; F24F 2221/36
See application file for complete search history.

(56) References Cited

U.S. PATENT DOCUMENTS 2,320,436 A * 6/1943 Hull ..... F24F 1/60 62/262
2,433,104 A 12/1947 Eberhart
3,296,820 A 1/1967 Bauman
3,309,889 A 3/1967 Copp
3,372,557 A 3/1968 Dyas et al.
3,394,910 A 7/1968 Ulich
3,415,074 A 12/1968 Metcalfe
(Continued)

FOREIGN PATENT DOCUMENTS

CN 2560895 Y 7/2003
CN 101876466 A 11/2010
(Continued)

OTHER PUBLICATIONS

Guan, Guang H., United States Patent and Trademark Office, Office Action issued in U.S. Appl. No. 17/566,438, 93 pages, dated Oct. 5, 2023.

(Continued)

*Primary Examiner* — Joseph F Trpisovsky
(74) *Attorney, Agent, or Firm* — Gray Ice Higdon

(57) ABSTRACT

A window mounted air conditioning unit is disclosed. The A/C includes an indoor unit, an outdoor unit, and a bridge. The indoor unit and outdoor unit are operatively connected by a line set (electrical wiring, refrigerant piping, condensate drainage piping, communication wiring, etc.) that is flexible and extensible and that resides in the bridge. The bridge is extendable from a first position to a second position to accommodate window openings of varying thicknesses. The A/C appliance is mounted to a separate mounting bracket that is itself extendable for varying width openings. The outdoor unit is pivotally connected to the bridge so that the outdoor unit can assume a first orientation during installation through a window opening, and a second orientation after passing through the window opening.

20 Claims, 14 Drawing Sheets

(56) References Cited

U.S. PATENT DOCUMENTS

| | | | |
|---|---|---|---|
| 3,491,549 | A | 1/1970 | Oglesby |
| 3,554,476 | A | 1/1971 | Gaylor |
| 3,576,114 | A | 4/1971 | Sharp et al. |
| 4,079,813 | A | 3/1978 | Ellison |
| 4,729,540 | A | 3/1988 | Rozema |
| 5,027,614 | A | 7/1991 | Mori |
| 5,035,116 | A | 7/1991 | Main |
| 5,167,131 | A | 12/1992 | Karkhanis |
| 5,191,770 | A | 3/1993 | Kim |
| 5,582,025 | A | 12/1996 | Dubin et al. |
| 5,823,289 | A | 10/1998 | Csomos |
| 6,481,228 | B1 | 11/2002 | Chiang |
| 6,568,201 | B1 | 5/2003 | Cur et al. |
| 6,767,278 | B1 | 7/2004 | Peterson |
| 7,296,424 | B2 | 11/2007 | Thompson |
| 7,383,923 | B2 | 6/2008 | Patten et al. |
| 8,167,260 | B2 | 5/2012 | Boccia |
| 8,533,955 | B2 | 9/2013 | Agnihotri |
| 8,584,998 | B1 | 11/2013 | Peterson |
| 8,925,176 | B2 | 1/2015 | Choi et al. |
| 9,163,854 | B2 | 10/2015 | Arbucci |
| 9,222,684 | B2 | 12/2015 | Cho et al. |
| 9,303,895 | B1 | 4/2016 | Grant |
| 9,447,916 | B2 | 9/2016 | Darby |
| D782,289 | S | 3/2017 | Darby |
| 9,915,394 | B2 | 3/2018 | Chen |
| 9,938,044 | B2 | 4/2018 | Gamboa |
| 10,203,130 | B2 | 2/2019 | Gardikis, Sr. |
| 10,295,221 | B2 | 5/2019 | Zhang |
| 10,401,043 | B2 | 9/2019 | Li |
| D884,461 | S | 5/2020 | Allen |
| 10,739,018 | B2 | 8/2020 | Baumann et al. |
| 10,760,795 | B2 | 9/2020 | Booten et al. |
| 10,775,054 | B2 | 9/2020 | Bradford et al. |
| 10,907,810 | B1 | 2/2021 | Moghal et al. |
| 11,125,479 | B1 | 9/2021 | Ingram |
| 11,168,920 | B1 | 11/2021 | Leezer et al. |
| 11,339,993 | B2 | 5/2022 | Zhao |
| 11,384,945 | B2 | 7/2022 | Aryeh |
| 11,397,023 | B2 | 7/2022 | Xing et al. |
| 11,397,024 | B2 | 7/2022 | Xing |
| 11,411,527 | B2 | 8/2022 | Simon |
| 11,415,329 | B2 | 8/2022 | Liu et al. |
| 11,441,791 | B2 | 9/2022 | Lei et al. |
| 11,441,792 | B2 | 9/2022 | Liang et al. |
| 11,498,163 | B2 | 11/2022 | Li et al. |
| 11,536,469 | B2 | 12/2022 | Si et al. |
| 11,566,815 | B2 | 1/2023 | Martinez Galvan |
| 11,619,241 | B2 | 4/2023 | Servies |
| 11,835,172 | B2 | 12/2023 | Dunn |
| 2009/0031744 | A1 | 2/2009 | D'Souza |
| 2009/0107162 | A1 | 4/2009 | Su et al. |
| 2009/0188174 | A1 | 7/2009 | Schreiber |
| 2015/0192309 | A1 | 7/2015 | Frolov |
| 2016/0131404 | A1 | 5/2016 | Mochizuki et al. |
| 2017/0284683 | A1* | 10/2017 | Gallo ..... F24F 13/0245 |
| 2019/0056143 | A1 | 2/2019 | Zhang |
| 2019/0063760 | A1 | 2/2019 | Li |
| 2019/0301668 | A1 | 10/2019 | Mai |
| 2020/0124296 | A1 | 4/2020 | Baumann |
| 2020/0217521 | A1 | 7/2020 | Lundstrom |
| 2020/0370764 | A1 | 11/2020 | Strickland |
| 2021/0010688 | A1 | 1/2021 | Biasotti et al. |
| 2021/0078118 | A1† | 3/2021 | Li |
| 2021/0088251 | A1 | 3/2021 | Galvan et al. |
| 2021/0164667 | A1 | 6/2021 | Yu et al. |
| 2021/0180828 | A1 | 6/2021 | Xing |
| 2021/0381700 | A1* | 12/2021 | Aryeh ..... F24F 13/32 |
| 2022/0056715 | A1 | 2/2022 | O'Mara |
| 2022/0228771 | A1* | 7/2022 | Si ..... F24F 13/32 |
| 2023/0026722 | A1 | 1/2023 | Yu |
| 2023/0126498 | A1 | 4/2023 | Li |
| 2023/0213214 | A1 | 7/2023 | Leezer et al. |
| 2023/0213215 | A1 | 7/2023 | DeRossett et al. |
| 2023/0213218 | A1 | 7/2023 | DeRossett |
| 2023/0375222 | A1 | 11/2023 | Leezer |
| 2024/0200825 | A1 | 6/2024 | Gray |

FOREIGN PATENT DOCUMENTS

| | | | |
|---|---|---|---|
| CN | 101876468 | A | 11/2010 |
| CN | 103299756 | A | 9/2013 |
| CN | 101876467 | B | 7/2014 |
| CN | 108679746 | A | 10/2018 |
| CN | 108931005 | A | 12/2018 |
| CN | 109163388 | A | 1/2019 |
| CN | 110657501 | A | 1/2020 |
| CN | 210320347 | U | 4/2020 |
| CN | 210399219 | U | 4/2020 |
| CN | 111219801 | A | 6/2020 |
| CN | 110657487 | B | 8/2021 |
| CN | 113465050 | A | 10/2021 |
| KR | 20210080821 | A | 7/2021 |
| WO | WO2018133140 | A1 | 7/2018 |
| WO | WO2018133156 | A1 | 7/2018 |
| WO | WO2020220828 | A1 | 11/2020 |
| WO | WO2020220830 | A1 | 11/2020 |
| WO | WO2020224096 | A1 | 11/2020 |
| WO | WO2020224328 | A1 | 11/2020 |
| WO | WO2020228409 | A1 | 11/2020 |
| WO | WO2021050726 | A1 | 3/2021 |

OTHER PUBLICATIONS

Trpisovsky, Joseph F., United States Patent and Trademark Office, Non-Final Office Action issued in U.S. Appl. No. 17/566,416, 66 pages, dated Feb. 28, 2024.

ForestAir, The Mini Series, Retrieved from: https://www.forestair.ca/en/serie-mini-anglais , Retrieved on Oct. 27, 2021.

Appliances Connection, How to Install Friedrich Breeze through the Window, Friedrich, Retrieved from: https://www.youtube.com/watch?v=cwK2-4PaVt8 , May 9, 2013.

Electrical Know How, Electrical Wiring Diagrams for Air Conditioning Systems—Part Two, Retrieved from:http://www.electricalknowhow.com/2014/05/electrical-wiring-diagrams-for-air-conditioning.html; Retrieved on Jul. 13, 2021.

Bright Hub Engineering, Parts of Split Air Conditioners: Outdoor Unit, Retrieved from:https://www.brighthubengineering.com/hvac/45044-parts-of-the-split-air-condioners-outdoor-unit/, Aug. 8, 2009.

Guan, Guang H., United States Patent and Trademark Office, Non-Final Office Action issued in U.S. Appl. No. 17/843,176, 81 pages, dated Jan. 22, 2024.

Top Shelf A/C Corporation; Top Shelf TSB-2438 Air Conditioner Bracket; retrieved from https://www.amazon.com/TOP-SHELF-TSB-2438-Conditioner-Bracket/dp/B00NKQFSH6; Amazon; dated 2022.

Alpine Hardware, Universal Window Air Conditioner Bracket—Heavy-Duty Window AC Support—Support Air Conditioner Up to 180 lbs.—For 12000 BTU AC to 24000 BTU AC Units (Heavy Duty), Retrieved from: https:// alpinehardware.com/collections/ac-brackets/products/universal-window-air-conditioner-bracket-heavy-duty-window-ac-support-support-air-conditioner-up-to-180-lbs-for-12000-btu-ac-to-24000-btu-ac-units-heavy-duty, Retrieved on: Apr. 27, 2022.

McNichols, Eret C., United States Patent and Trademark Office, Non-Final Office Action issued in U.S. Appl. No. 18/067,005, 90 pages, dated May 22, 2024.

Trpisovsky, Joseph F., United States Patent and Trademark Office, Notice of Allowance issued in U.S. Appl. No. 17/566,416, 28 pages, dated Aug. 5, 2024.

Guan, Guang H., United States Patent and Trademark Office, Final Office Action issued in U.S. Appl. No. 17/566,438, 52 pages, dated Apr. 25, 2024.

Guan, Guang H., United States Patent and Trademark Office, Notice of Allowance issued in U.S. Appl. No. 17/566,438, 98 pages, dated Sep. 18, 2024.

(56) References Cited

OTHER PUBLICATIONS

Guan, Guang H., United States Patent and Trademark Office, Final Office Action issued in U.S. Appl. No. 17/843,176, 54 pages, dated Aug. 14, 2024.
McNichols, Eret C., United States Patent and Trademark Office, Notice of Allowance issued in U.S. Appl. No. 18/067,005, 72 pages, dated Oct. 16, 2024.
Trpisovsky, Joseph F., United States Patent and Trademark Office, Notice of Allowance issued in U.S. Appl. No. 17/566,416, 28 pages, dated Nov. 22, 2024.

* cited by examiner
† cited by third party

WINDOW-MOUNTED AIR CONDITIONER

BACKGROUND

Air conditioning ("A/C") units are typically classified into split type air conditioning units and integral type air conditioning units. Split type air conditioning unit usually include an indoor unit and an outdoor unit. The indoor unit is installed indoors, and draws indoor air into the unit to allow the drawn air to exchange heat with refrigerant, and discharges the heat-exchanged air to the conditioned indoor space. The outdoor unit allows the refrigerant introduced from the indoor unit to exchange heat with outdoor air such that the refrigerant is in a state available for heat exchange with indoor air, and then provides the refrigerant to the indoor unit. The indoor unit and the outdoor unit are usually connected to each other by a refrigerant pipe through which refrigerant flows.

By contrast, integral type air conditioners (e.g., standard window air conditioning units) usually include all the unit components, such as electrical panels, heat exchangers (e.g., evaporators, condensers), compressors, and fans, encased in a housing as a single packaged unit, which is mounted in a window opening atop a window sill. These window A/C units occupy a large portion of the window space, block sunlight and window view, and hinder the ability of the window to be opened or closed freely. In addition, they are difficult to install, and are commonly of relatively low efficiency because of the size limitations of the window-mounted packaged housing.

As a solution to some of the problems associated with standard integrated window A/C units, "saddle-type" window units have been developed. A saddle-type window A/C unit is basically a hybrid between a split-type unit and an integral unit, in which an outdoor unit is separate from, but functionally coupled to, an indoor unit. The saddle unit sits on a mounting bracket that straddles the sill of a window opening. These saddle-type units, however, are difficult to install due, in part, to their size and their relative inability to adjust to various size openings and window thicknesses. Standard saddle-type window units have one or more feet that must be adjusted independently while the heavy unit is being installed. This is not only cumbersome, because the feet are outside the window and the unit is very heavy, but also dangerous for the installer (and persons beneath) if the installation is high above ground. Also, although some window A/C units in the past have attempted to add a heat pump, none of such units could operate at very cold temperatures. In fact, most would cease operating around 40 degrees Fahrenheit. Adding a larger heat pump would make the unit not fit within many standard window openings. Adding such a cold weather heat pump to a window A/C unit would add approximately 6"-8" to the height and approximately 6"-8" to the width of such a window A/C unit. And, such a heat pump would also add approximately an additional 50% to 90% of weight to the appliance. As a result, not only would it be extremely dangerous to attempt to install such a heavy appliance through a window, but the added size of such an apparatus would not even fit through most standard window openings in the first place. Therefore, window A/C units are suitable only for summer use.

Accordingly, with or without a heat pump, a need exists in the art for a window-mounted air conditioner that can be installed through most standard window openings. Also, it is desired to provide such an appliance that also includes features of full adjustability for many window openings and widths. Also, it is desired to have an appliance in which the indoor and outdoor portions are functionally connected at all times without the need for a technician to disconnect or reconnect refrigerant lines or other conduits during or after installation.

SUMMARY

The herein-described embodiments address these and other problems associated with the art by providing a new air conditioner having adjustability in the thickness of walls/sills to which it can be mounted; including flexible line sets that are already connected between the indoor unit and outdoor unit; and providing an appliance wherein the outdoor unit is both telescopically connected but also pivotally connected to a bridge, allowing the outdoor unit to pass through a window in a first configuration, and then rotate into a second configuration.

Another related object of the disclosure is to provide such an air conditioning unit that includes a separate mounting bracket that is installed in the window opening prior to installation of the air conditioner. Yet another object is to provide such an air conditioning unit that is relatively inexpensive and practical for self-installation, and enables the inclusion of a heat pump within the A/C unit. Other objects and advantages of the disclosed apparatus will become apparent from the specification and appended claims and from the accompanying drawing illustrative of the invention.

In some embodiments, a window air conditioner is provided having an indoor unit configured for operation within an air-conditioned space and having an indoor unit housing and an indoor heat exchanger and a fan, all located within the indoor unit housing; an outdoor unit configured for installation exteriorly of the air-conditioned space and having an outdoor housing and an outdoor heat exchanger, a compressor, and a fan, all located within the outdoor housing; a bridge fixedly coupled to the indoor unit and rotationally coupled to the outdoor unit. The bridge includes a first portion and a second portion telescopically connected to the first portion, wherein the first portion and the second portion define an internal open space therebetween, wherein the internal open space houses a flexible line set. The flexible line set includes refrigerant piping and electrical wiring coupled to the indoor unit and the outdoor unit such that the heat exchanger of the indoor unit is operatively connected with the compressor and the outdoor heat exchanger of the outdoor unit. The bridge further includes a hinge having a first end and a second end, wherein the first end of the hinge is connected to the second portion of the bridge, and wherein the second end of the hinge is connected to the outdoor unit, whereby the outdoor unit is rotatable about an axis through the bridge from a first orientation to a second orientation, wherein the second orientation is rotated approximately 90 degrees from the first orientation. The air conditioner further includes, as a separate and independent structure, a support bracket that is configured to be separately installed at the window opening, the support bracket including an indoor member, an outdoor member, and a telescoping bridge portion connecting the indoor member and the outdoor member.

In some embodiments, a window air conditioner for a window opening is provided having a first unit disposed inside a conditioned space; a second unit disposed outside a conditioned space; a bridge comprising a first portion and a second portion operatively and telescopically coupled to the first portion; wherein the bridge telescopically extends through the window opening; wherein said first unit is fixedly coupled to the first portion of the bridge and the second unit is rotatably coupled to the second portion of the bridge; wherein the bridge further comprises an interior open space between the first portion and the second portion, which contains refrigerant piping and electrical wiring, each of which is permanently but flexibly coupled between the first unit and the second unit. The window air conditioner further includes a support bracket separate from the first unit, the second unit, and the bridge, and onto which the first unit, the second unit, and the bridge is installed.

In some embodiments, a method of installing a window air conditioner is provided, wherein the window air conditioner involved includes an indoor unit, an outdoor unit, and a bridge telescopically connecting the indoor unit to the outdoor unit, and wherein the outdoor unit is further rotatably coupled to the bridge enabling the outdoor unit to rotate from a first orientation to a second orientation, the method comprising: providing a support bracket having a first wall-facing member, a bridge surface, and a second wall-facing member, the bridge telescopically coupling the first wall-facing member and the second wall-facing member; installing the support bracket in a window opening such that the bridge resides over a sill, the first wall-facing member is coupled to an interior wall within a conditioned space, and the second wall-facing member is coupled to an exterior wall outside the conditioned space; ensuring the outdoor unit is rotated into the first orientation with respect to the bridge; placing the air conditioner on the support bracket such that the outdoor unit rests atop the bridge; sliding the air conditioner toward the exterior of the window opening until a surface of the indoor unit contacts the first wall-facing member; locking the indoor unit to the support bracket; rotating the outdoor unit downwardly until the outdoor unit contacts the second wall-facing member; locking the outdoor unit to the support bracket; and connecting the air conditioner to an electrical power source.

These and other advantages and features, which characterize the invention, are set forth in the claims annexed hereto. For a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
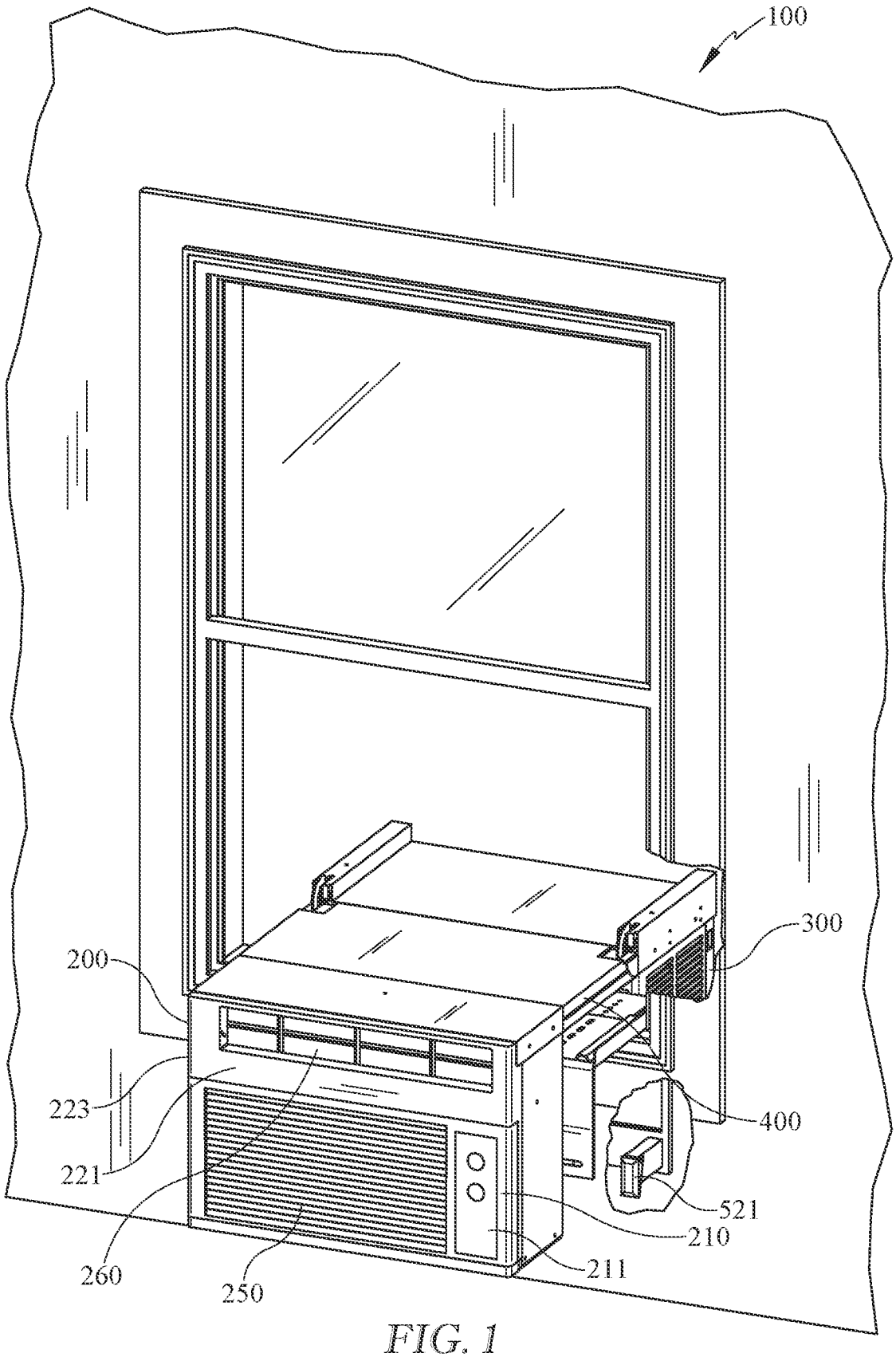
FIG. 1 is a perspective view of an air conditioner in an installed configuration, viewed from inside a conditioned space, according to an embodiment.

The embodiments discussed hereinafter are directed in part to a window-mounted air conditioner and a method for installing the same. The structures, features, and functionality of the disclosed apparatus are significant improvements over the prior art. The apparatus described herein provides a structure for a novel air conditioner and methods of installation. The air conditioner remains functionally coupled as a unit, even when occupying a telescoping configuration and also a rotational orientation. The embodiments shown and described include a window air conditioner having an indoor unit and an outdoor unit connected by a bridge containing the piping/conduits and wiring between the indoor unit and the outdoor unit.

Turning now to the drawings, wherein like numbers denote like parts throughout the several views, the overall configuration of an integral-type window air conditioning unit (air conditioner) 100 will now be described with initial reference to FIGS. 1-6, according to an embodiment. In the embodiment shown, the air conditioner 100 includes a first unit (indoor unit 200), a second unit (outdoor unit 300), and a bridge 400. The indoor unit 200 of the air conditioner 100 includes a front panel 210 and a user interface 211. The functional components of the indoor unit 200, including an indoor heat exchanger 230 and an indoor fan 240, are contained within an indoor unit housing 220. In the figures, these working components have been removed from the indoor housing 220 for clarity in the views. The indoor unit housing 220 includes a front 221, rear 222, left side 223, right side 224, top 225, and bottom 226 (see FIGS. 2 and 3). The indoor unit 200 further includes an air inlet 250 and an air outlet 260.

The indoor heat exchanger 230 functions as a condenser/radiator during a heating operation, and as an evaporator during a cooling operation. The indoor fan 240 may be disposed proximate the indoor heat exchanger 230 to direct air to the indoor heat exchanger 230 and the air-conditioned space. The air inlet 250 and air outlet 260 can have varying arrangements and locations on the front panel 210, according to various embodiments. The air inlet 250 and air outlet 260 introduce air from/to the air-conditioned space, respectively. In some embodiments, the air inlet 250 may be formed at an upper portion of the front panel 210 and the air outlet 260 may be formed at a lower portion of the front panel 210. This type of arrangement is shown in FIG. 1. The air taken from the air inlet 250 passes through the indoor heat exchanger 230, where the air exchanges heat. Then, the conditioned air is blown through the air outlet 260 into the air-conditioned space. In some embodiments, one or more baffles may be provided with the air inlet 250 or air outlet 260, respectively, to facilitate desired air flow and direction.

Figure 2:
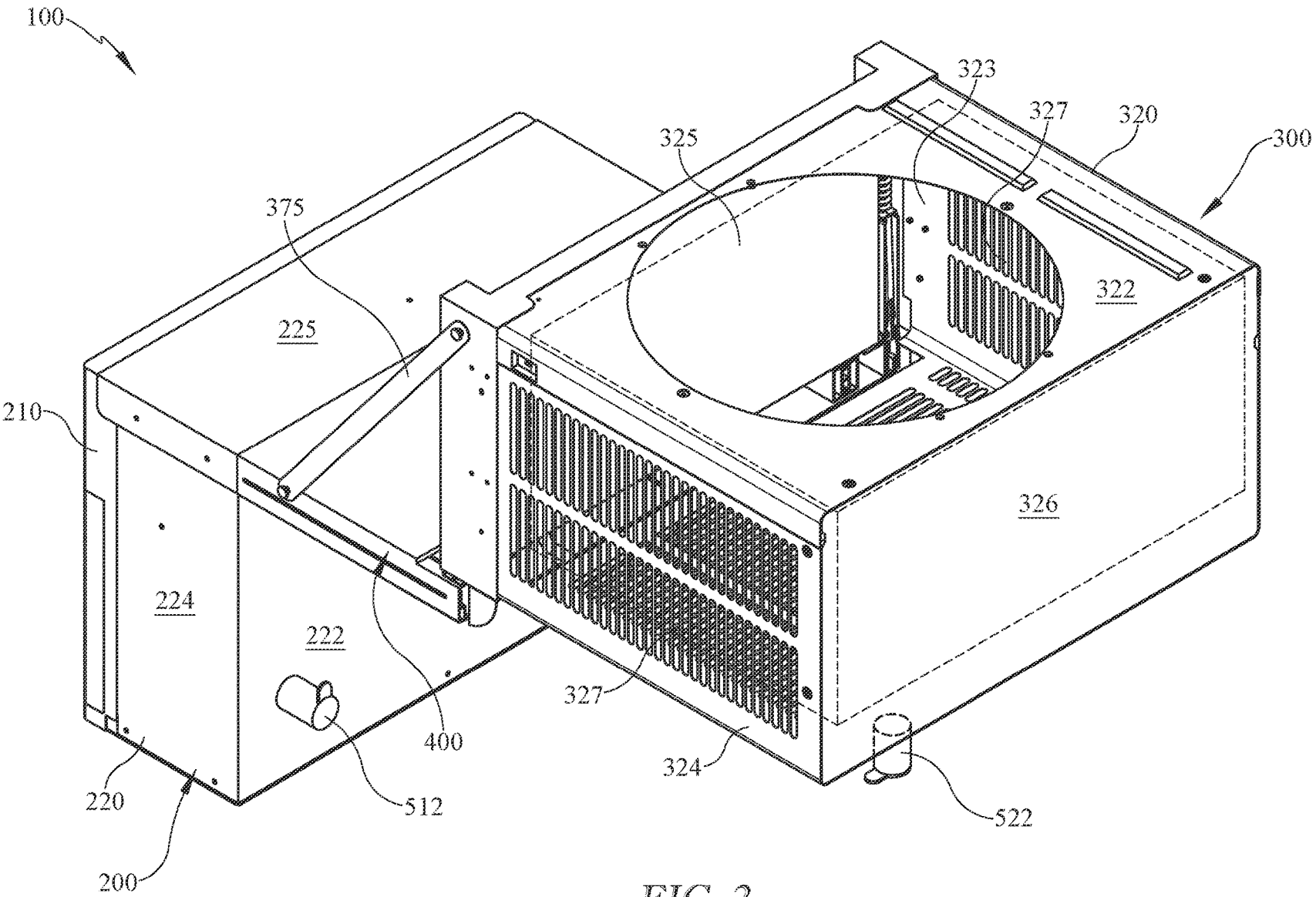
FIG. 2 is a perspective view of an air conditioner wherein the outdoor unit is in a first orientation, according to one embodiment.
Figure 3:
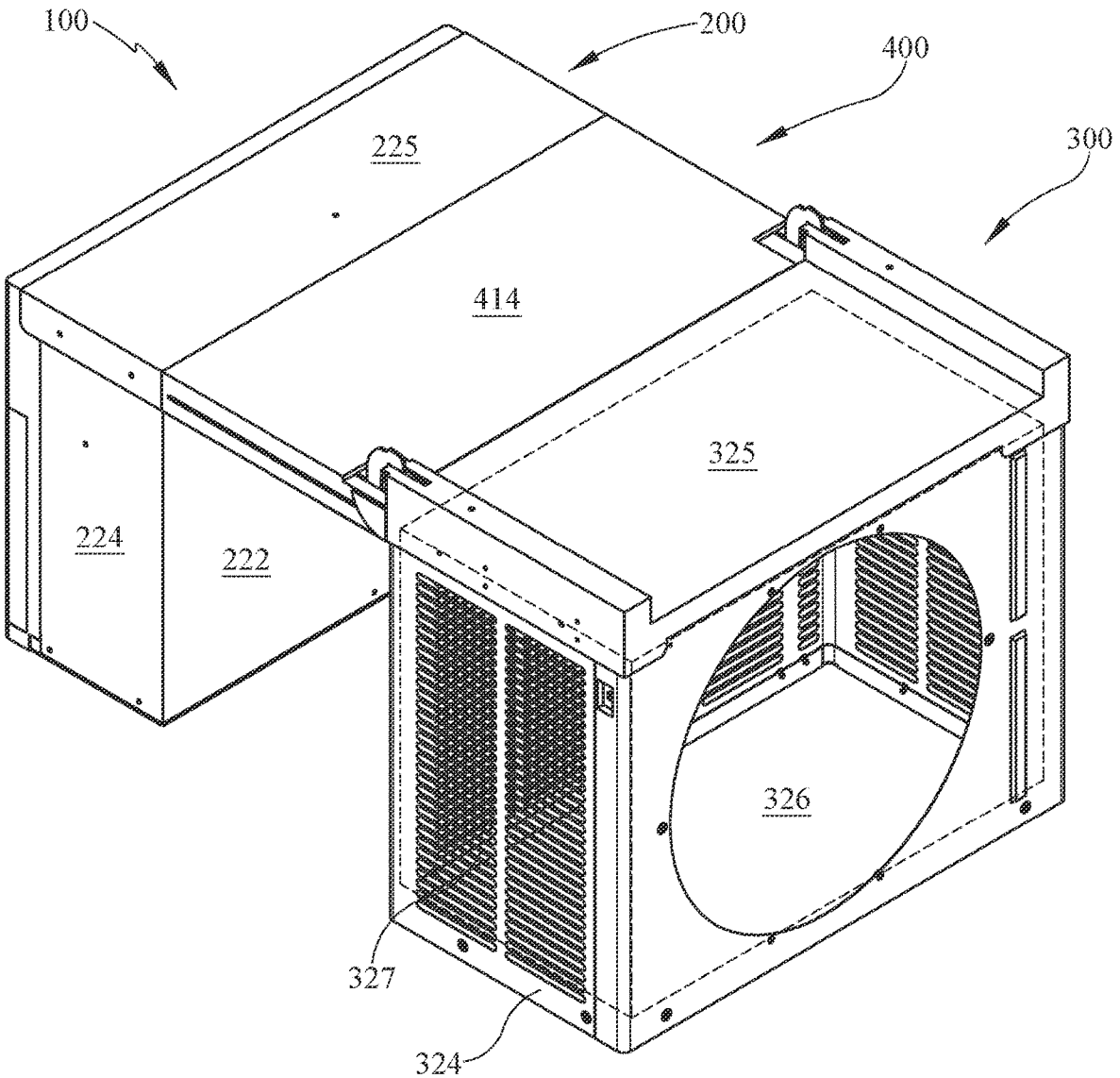
FIG. 3 is a perspective view of the air conditioner of FIG. 2 wherein the outdoor unit is in an installed orientation, according to one embodiment.
Figure 6:
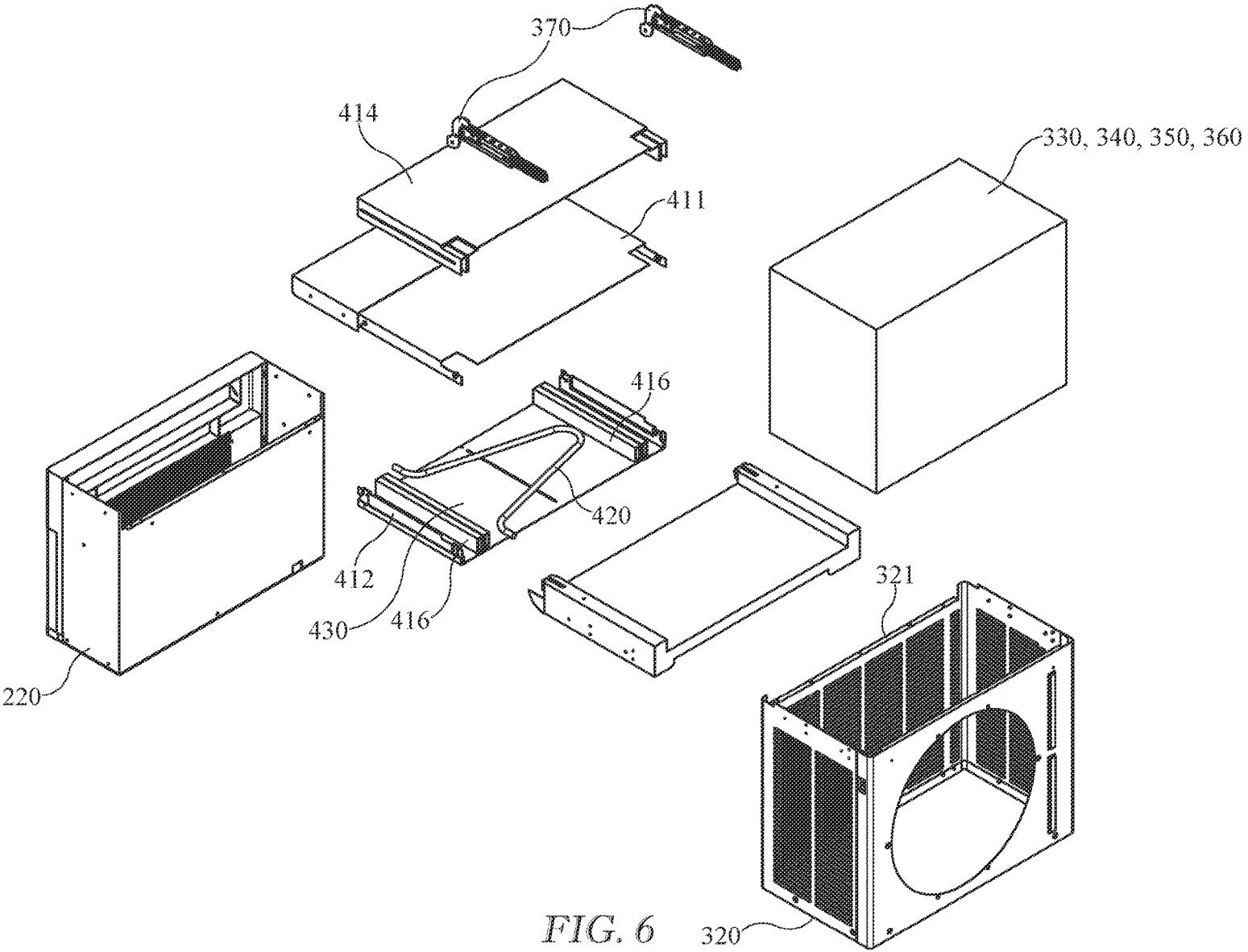
FIG. 6 is an exploded perspective view of an air conditioner according to one embodiment.

The outdoor unit 300 of the air conditioner 100 may include an outdoor unit housing 320 having panels such as a front 321, a rear 322, a left side 323, a right side 324, a top 325, and a bottom 326 (see FIGS. 2 and 3). The outdoor unit housing 320 contains a heat exchanger 330, a compressor 340, and an outdoor fan 350. In some embodiments, the outdoor unit housing 320 also contains an inverter 360. In the figures, these working components have been removed from the outdoor housing 320 for clarity in the views. In FIG. 6, these components are simply shown schematically as a box. The outdoor heat exchanger 330 functions as an evaporator during a heating operation and as a condenser/radiator during a cooling operation, and the outdoor fan 350 may be configured to direct outside air to the outdoor heat exchanger 330 for better heat exchanging performance. One or more air openings 327, through which external air may be introduced or discharged, may be formed on one or more panels of the outdoor unit housing 300. For example, the front 321 and/or one or more of the left side 323 and right side 324, and/or the rear 322, and/or the top 325 or bottom 326 may have the air openings 327 to allow outside air to pass therethrough. During cooling operation, the compressor 340 compresses the refrigerant, and the compressed refrigerant is introduced into the condenser 330 and condensed. In such embodiments, the outdoor fan 350 may draw the external air through one or more of the panels 321, 322, 323, 324, 325, or 326 to cool the condenser 330. In some embodiments, the outdoor unit 300 may be equipped with a variable speed inverter 360 to configure a variable rotation speed type compressor for improved efficiency and capacity as well as low temperature heat pump operation. The indoor unit 200 and/or the outdoor unit 300 may also include a flow rate control device, like a pressure reducing device such as an expansion valve, that reduces the pressure of the refrigerant, so the air may be conditioned by the refrigeration cycle.

Figure 4:
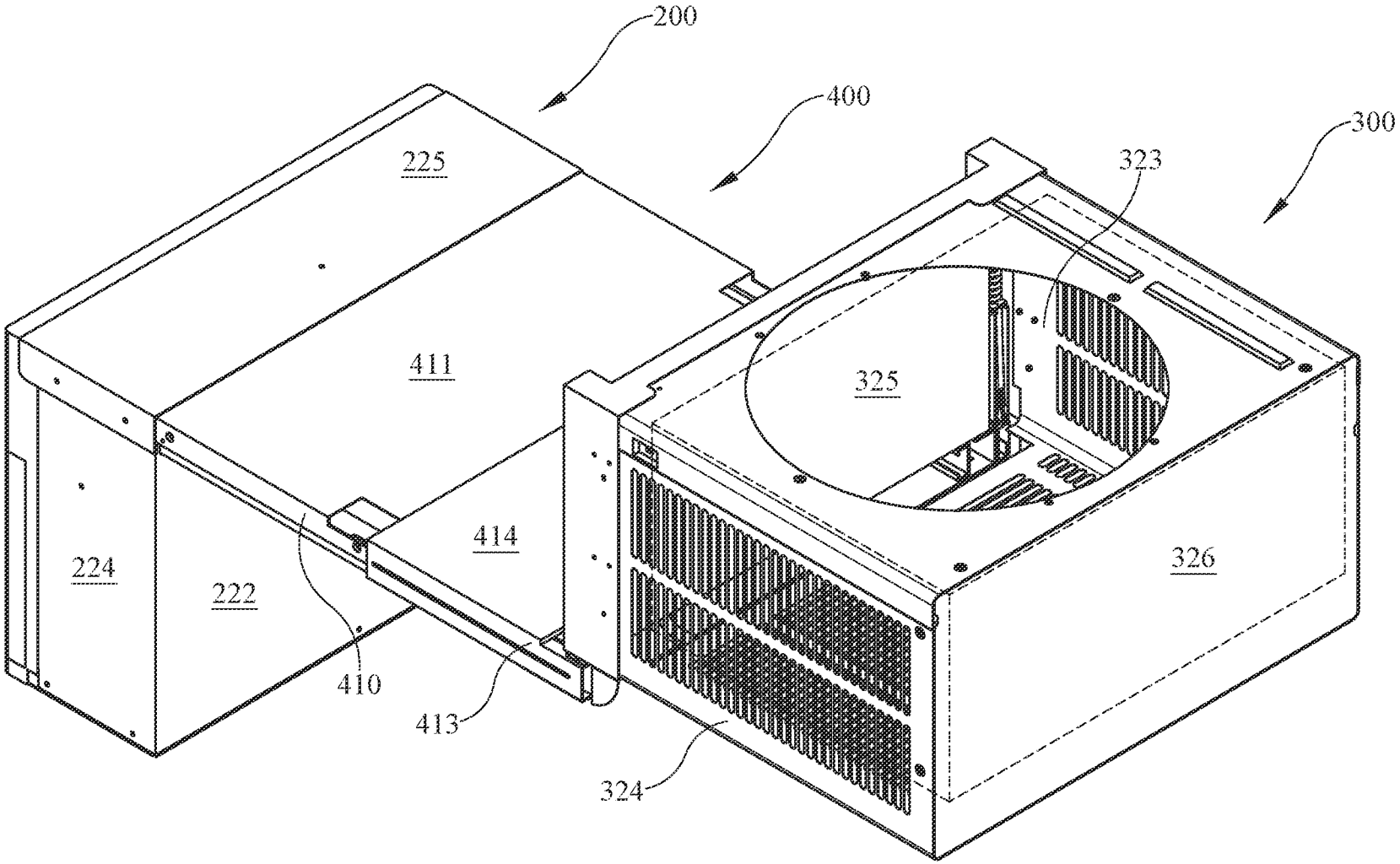
FIG. 4 is a perspective view of the air conditioner of FIG. 2 wherein the bridge is in an extended configuration and the outdoor unit is in a first orientation, according to one embodiment.
Figure 5:
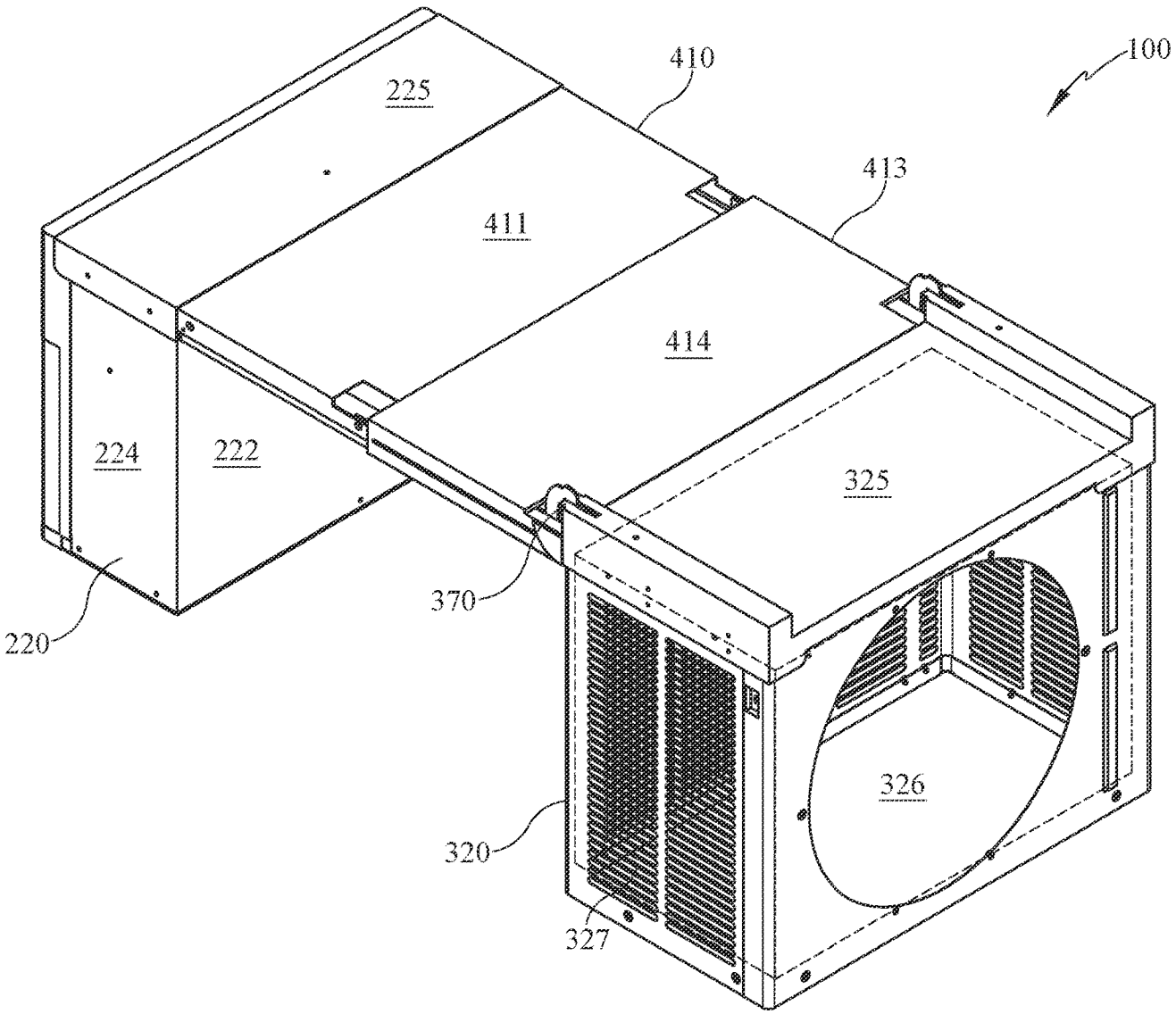
FIG. 5 is a perspective view of the air conditioner of FIG. 4 wherein the bridge is in an extended configuration and the outdoor unit is in an installed orientation, according to one embodiment.

With reference to FIGS. 4-6, and continuing reference to FIGS. 1-3, the air conditioner 100 also includes a bridge 400 that connects the indoor unit 200 to the outdoor unit 300. The bridge 400 includes a first portion 410 having a top cover 411 and a base 412. The bridge also includes a second portion 413 having a top cover 414 and a base 415. The first portion 410 and the second portion 413 are telescopically connected via one or more support rails 416. The first portion 410, or an extension of the bridge 400, is coupled to the indoor unit 200, and the second portion 413 is rotatably or hingedly coupled to the outdoor unit 300. When desired, the first portion 410 and second portion 413 can slide telescopically relative to one another from a first (contracted) configuration to a second (extended) configuration. This allows the distance between the indoor unit 200 and the outdoor unit 300 to vary so as to accommodate sills or openings of various thicknesses. The bridge 400 also defines an internal space 430 therein between the top covers 411, 414 and the bases 412, 415. With reference to FIG. 6, various structures are located within the internal space 430, including, but not limited to, electrical wiring 421; high-pressure refrigerant conduits 422; low-pressure refrigerant conduits 423; condensate drain conduits 424; and communication wiring 425; each of which is connected on one end to relevant structures of the indoor unit 200, and on the other end to relevant structures of the outdoor unit 300. Collectively, these structures 421, 422, 423, 424, and 425 are referred to herein as "line sets" 420, and are represented only schematically in FIG. 6 as a single flexible conduit. The line sets 420 are flexible and/or extendible in length (extensible) in nature so that they continue to be operational regardless of whether the bridge 400 is in the first configuration or the second configuration. Because the line sets 420 are flexible and/or extensible, their respective ends can be connected to the relevant structures of the indoor unit 200 and the outdoor unit 300 during manufacture, and never need to be connected or disconnected by a consumer during installation. In other words, the indoor unit 200 and outdoor unit 300 remain fully operationally connected to each other at all times, regardless of the size of the window opening in which the air conditioner 100 is installed, and regardless of the configuration of the bridge and regardless of the orientation of the outdoor unit 300 with respect to the bridge 400 (discussed below). As a result, the air conditioner 100 remains a fully complete and functional appliance regardless of the configuration (that is, state of extension or retraction of the bridge 400) and the orientation of the outdoor unit 300.

Figure 7:
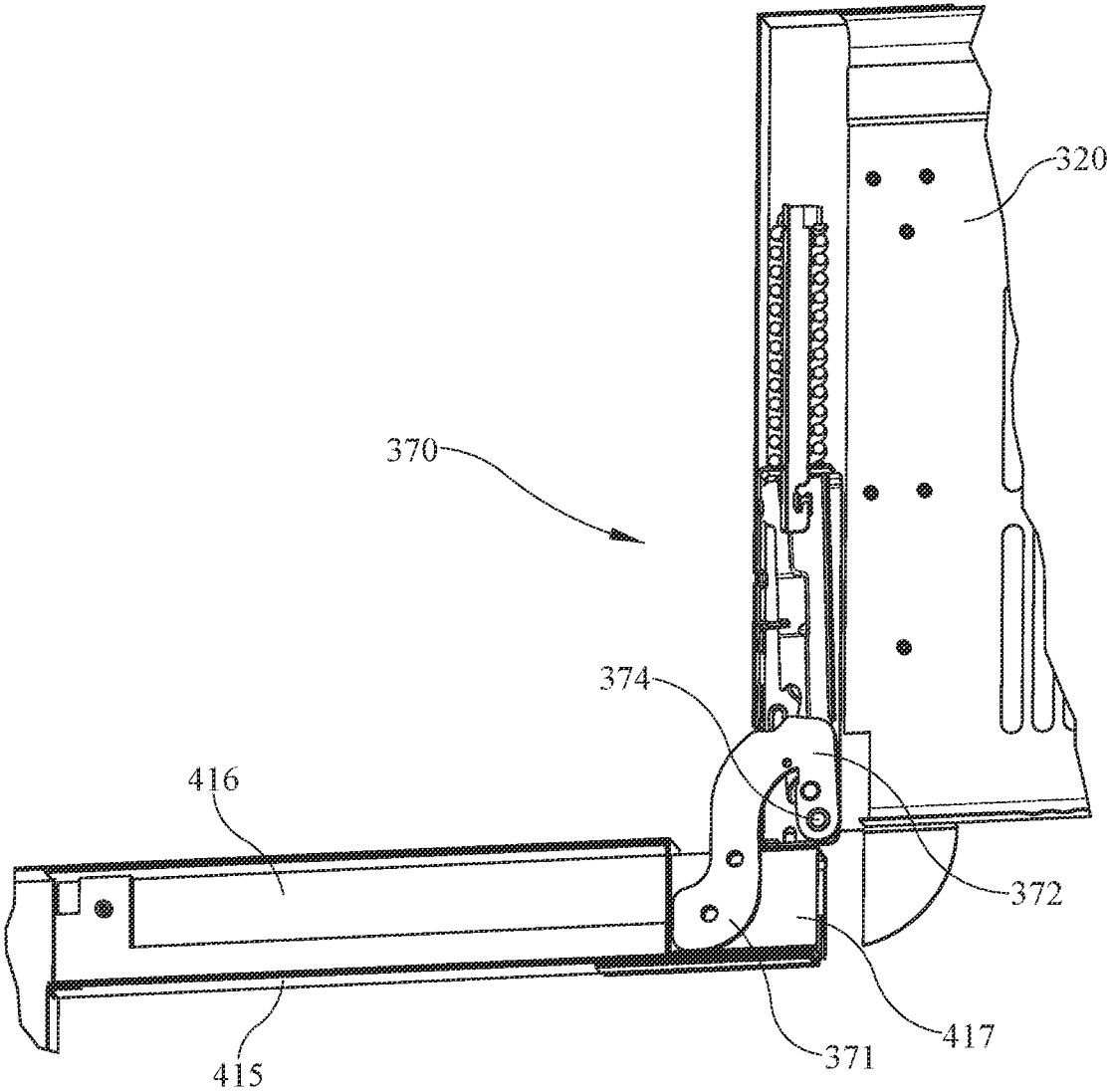
FIG. 7 is a left side view of a portion of a hinge connection between the outdoor unit and the bridge of the air conditioner, according to an embodiment.
Figure 8:
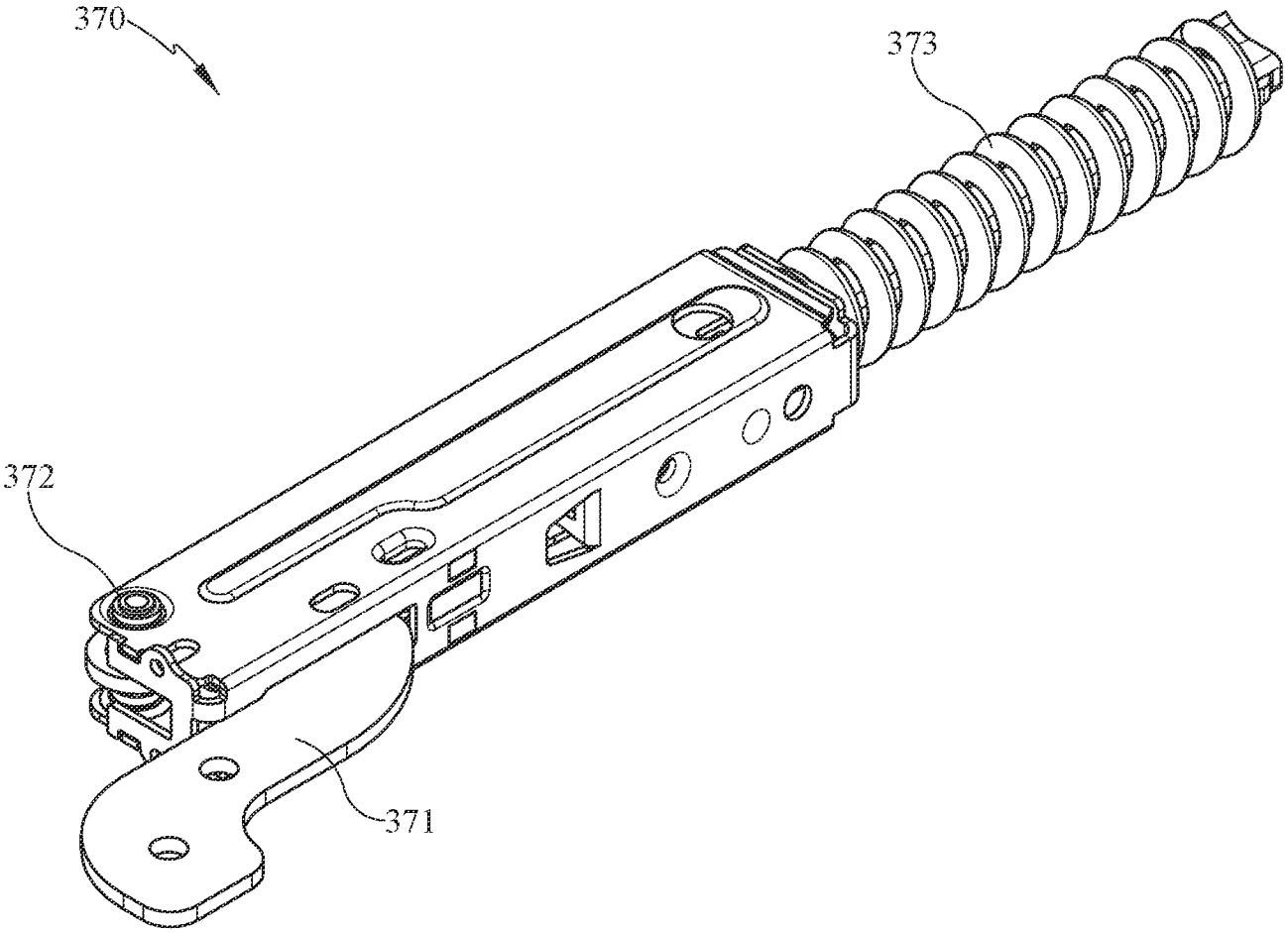
FIG. 8 is a top perspective view of a hinge for the air conditioner, according to one embodiment.

With continuing reference to FIGS. 3, 5, and 6, the outdoor unit 300 is hingedly connected to the second portion 413 of the bridge 400. Two hinges 370, one on each side of the outdoor unit 300, are preferably provided. The hinges 370 can be of any of the known styles and types of hinges known in the appliance industry or other industry for safely and securely rotating heavy items. One example is a hinge similar to that used for oven doors. The particular design of the hinge 370 described herein and shown in the Figures is simply exemplary of one of many types of hinges possible. For safety and effective use, the hinges must be of a size and strength needed to safely handle the weight of the outdoor unit 300. As shown in FIGS. 7 and 8, each hinge 370 has a first end 371 and a second end 372 and a bias member 373. The first end 371 is connected to the bridge 400 at hinge mount 417, and the second end 372 is connected to the outdoor unit 300 at hinge mount 374. The bias member 373 serves to facilitate the rotation of the outdoor unit 300 and can provide a damping force or an assisting force, depending on the direction of rotation of the outdoor unit 300. The damping increases the safety by preventing accelerated rotational movement of the outdoor unit 300. The damping mechanism may be, for example, a coil spring, a spring damper, a pneumatic spring (gas spring), or any other type of suitable components to slow or control the motion and movement of the outdoor unit 300 during installation. Additionally, a rotational lock 375, an example of which is shown in FIG. 2, enables a user to releasably lock the orientation of the outdoor unit 300 with respect to the bridge 400. When the outdoor unit 300 occupies its first orientation, where the top 325 is perpendicular to the top cover 414, the rotational lock 375 is engaged so as to securely retain the outdoor unit 300 in that rotational orientation (i.e., the first orientation). Disengaging the rotational lock 375 allows the outdoor unit 300 to rotate from its first orientation downwardly through a range of orientations to its second, installed orientation. In this second orientation the top 325 is parallel to the top cover 414.

Figure 9:
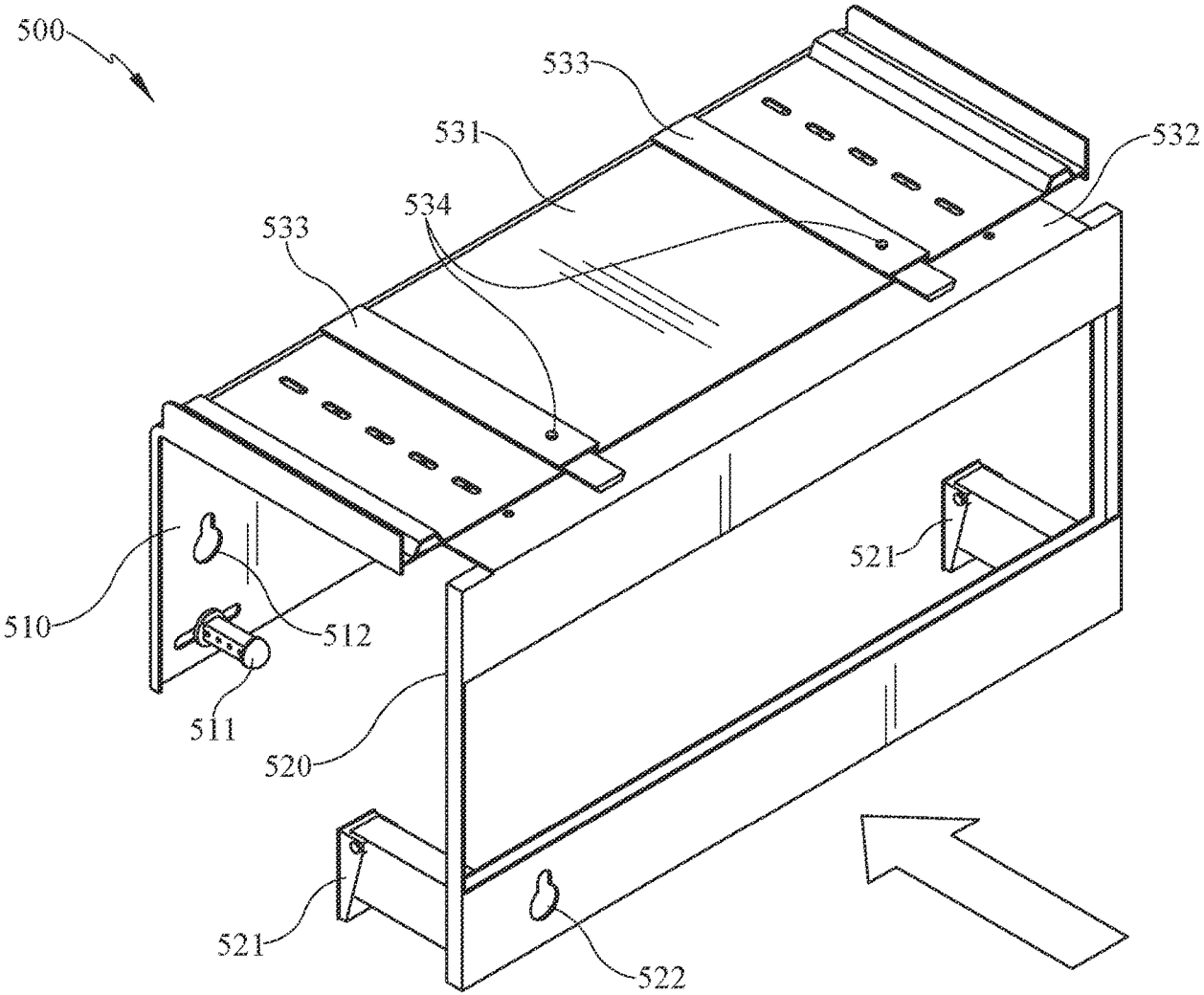
FIG. 9 is a perspective view of a support bracket for the air conditioner in a first configuration, according to one embodiment.
Figure 10:
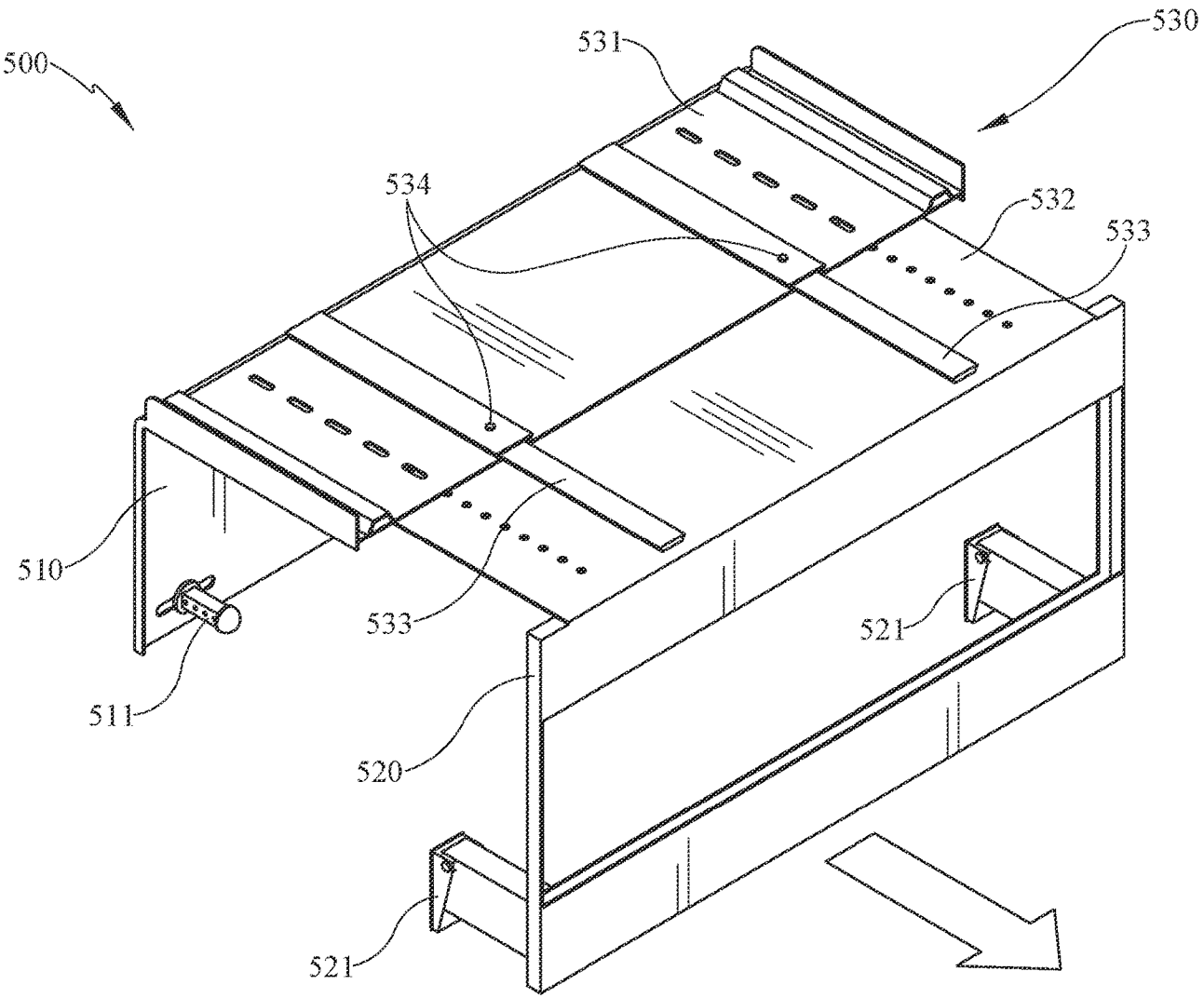
FIG. 10 is a perspective view of the support bracket of FIG. 9 in a second configuration, according to one embodiment.

Referring now to FIGS. 9 and 10, the support bracket 500 for the air conditioner 100 will be described. The support bracket 500 is a separate structure from the air conditioner 100, and is not part of the indoor unit 200, the outdoor unit 300, or the bridge 400. Support bracket 500 is a substantially upside-down U-shaped (saddle-shaped) support bracket that includes a first wall-facing member 510 and a second wall-facing member 520 connected by a support bracket bridge 530. The support bracket bridge 530 is a basically horizontal member that resides over a sill or window opening. The first wall-facing member 510 is located inside the air-conditioned room, while the second wall-facing member 520 is located outside the air-conditioned room. The support bracket bridge 530 has a first portion 531 and a second portion 532 that are slidably extendable from a first (contracted) configuration to a second (extended) configuration on one or more support rails 533. The arrows in FIGS. 9 and 10 show the direction of travel. Because of this telescopic arrangement, the first wall-facing member 510 can be situated at varying distances from the second wall-facing member 530. This facilitates the use of the support bracket 500 on sills or in openings of various thicknesses. Preferably the first portion 531 and second portion 532 have a telescoping lock 534 (see, e.g., FIGS. 9 and 10) that allows a user to lock the distance between the first portion 531 and second portion 532 once the desired distance is found. This telescoping lock 534 can take many forms, including, but not limited to, locking features within or along the sides of the first portion 531 and second portion 532. For example, such features can include, but are not limited to, ball/detent; pin/hole; pin/slot; bolts, ratchet/pawl; and the like.

With continued reference to FIGS. 9 and 10, the first wall-facing member 510 preferably includes structures to facilitate securement to the interior wall, while also preventing serious damage to the wall. As but one example, one or more adjustable feet 511 may be employed on the first wall-facing member 510. These feet 511 can adjust (e.g., rotatably, slidingly, threadedly, and the like) so as to make secure contact to the interior wall. The feet 511 can be fitted with non-marring or soft surfaces to prevent wall damage. The first wall-facing member 510 also can include an indoor unit lock 512 (see, e.g., FIGS. 2, 9, and 10). The second wall-facing member 520 preferably includes structures to facilitate securement to the exterior wall (that is, outside), while also, if desired, preventing serious damage to the wall. As but one example, one or more adjustable feet 521 may be employed on the second wall-facing member 520. These feet 521 can adjust (e.g., rotatably, slidingly, threadely, and the like) so as to make secure contact to the exterior wall. The feet 521 can, if desired, be fitted with non-marring or soft surfaces to prevent wall damage. The second wall-facing member 520 also can include an outdoor unit lock 522 (FIGS. 2, 9, and 10), e.g., on the lower portion second wall-facing member 520.

Referring again to FIGS. 2-6 and as discussed above, the indoor unit 200 is connected to the outdoor unit 300 via the bridge 400, which contains and houses the line sets 420, which include refrigerant piping and electrical wiring connecting the indoor unit 200 and the outdoor unit 300. In this way the indoor heat exchanger 230 is operatively connected with the compressor 340 and the outdoor heat exchanger 330 through the bridge 400. For example, during cooling operation, a refrigerant may be compressed to a high pressure and a high temperature by the compressor 330. Then, the refrigerant experiences a heat exchange through the outdoor fan 350 and a condensation effect to form a high-pressure refrigerant liquid. Next, the high-pressure refrigerant liquid is transferred to the indoor unit 200 through a refrigeration conduit, flexibly passing through the bridge 400, and the pressure of the refrigerant liquid is decreased by passing through a flow rate control device (e.g., an expansion valve). Meanwhile, the refrigerant introduced to the indoor heat exchanger 230 (e.g., the evaporator) of the indoor unit 200 is evaporated to absorb heat from ambient air. Cooled air, which is formed through the absorption of heat by the evaporator 230, is discharged to the air-conditioned space through the indoor fan 240 disposed adjacent to the 230 evaporator, and a low-pressure refrigerant gas, which has been evaporated by the evaporator 230, is transferred back to the outdoor unit 300 through the refrigeration conduit connecting a low pressure refrigerant line within the open space of the bridge 400.

In some embodiments, the bridge 400, including the high-pressure refrigerant conduit 422 and low-pressure refrigerant conduit 423, which is connected to the indoor unit 200 and the outdoor unit 300, may include additional components, such as a condensation (condensate) drain conduit 424, as well as electrical wiring 421 and possibly communication wiring 425. In such embodiments, the bridge 400 may be configured to accommodate, protect, and hide all required line sets between the indoor unit 200 and the outdoor unit 300. For example, the condensate drain conduit 424, which is usually supplied with the indoor heat exchanger 230, may be a certain length of insulated drain hose with one end connected to the condensate drain pan inside the indoor unit 200 and the other end connected to a suitable condensate outlet (e.g., a drainage system) inside or, more often, outside of the air-conditioned space. As part of the condensate drain there may also or alternatively be one or more pumps (not shown) to assist in removing condensate from the indoor unit 200. A drain plug also would be accessible from the indoor side. In some embodiments, the power cable with plug may be electrically extended from the outdoor unit 300 through the bridge 400 to electrically couple with a power outlet 10 on the interior wall 1. Therefore, the disclosed air conditioner 100 may not require any alterations to any electrical wiring system of the air-conditioned space for installation. In such embodiments, one or more electrical cables within the bridge 400 may be configured to supply power to and communicate with the indoor unit 200. For example, in some embodiments, the electrical cable may be used both to power the indoor heat exchanger 230 and indoor fan 240 as well as to provide electrical signals to enable the indoor heat exchanger 230 to communicate with the outdoor heat exchanger 330 and the compressor 340.

The line sets 420 may be made from any material (e.g., plastic, fabric, metal, flex hose, coiled tubing, coiled wire, etc.) that provides the properties of flexibility and/or length adjustment (extensibility) for allowing the outdoor unit 300 to be telescopically connected to the indoor unit 200 without damaging the lines or disconnecting them from either the indoor unit 200 or the outdoor unit 300.

Figure 11:
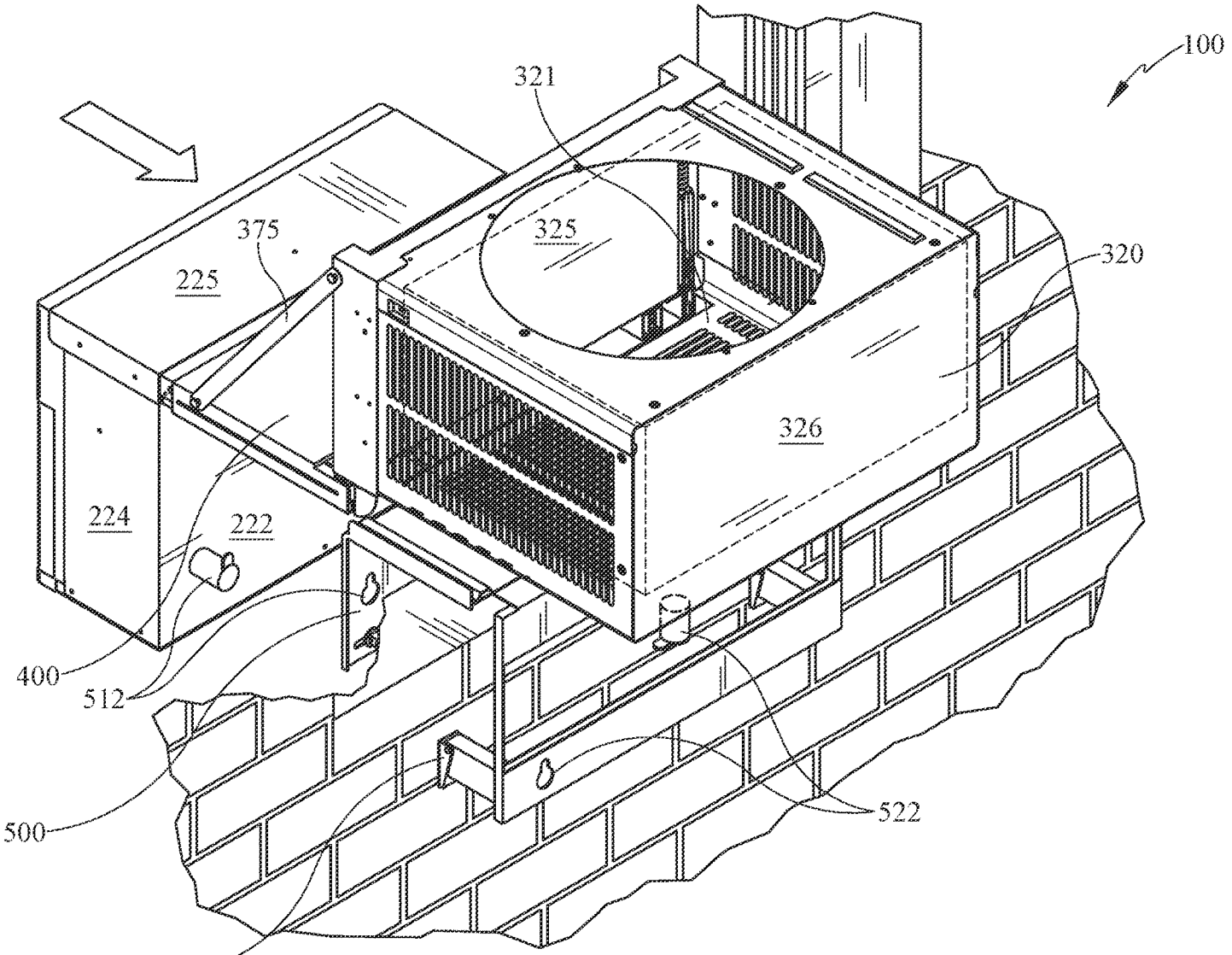
FIG. 11 is a perspective view of an air conditioner and support bracket according to an embodiment in a first step of installation, with the bridge in a first configuration and the outdoor portion of the air conditioner in a first orientation.
Figure 12:
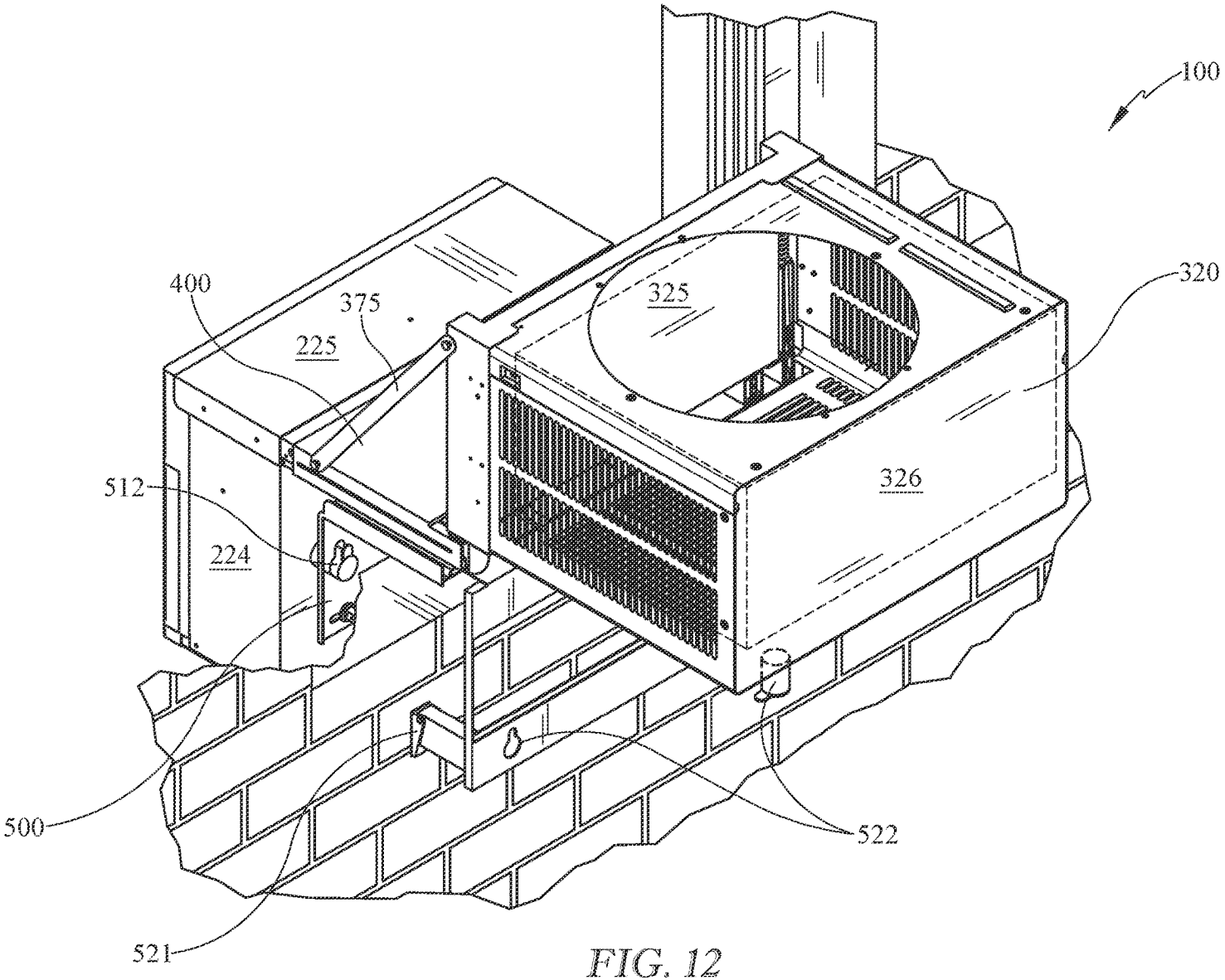
FIG. 12 is a perspective view of the air conditioner and support bracket of FIG. 11 in a second step of installation.
Figure 13:
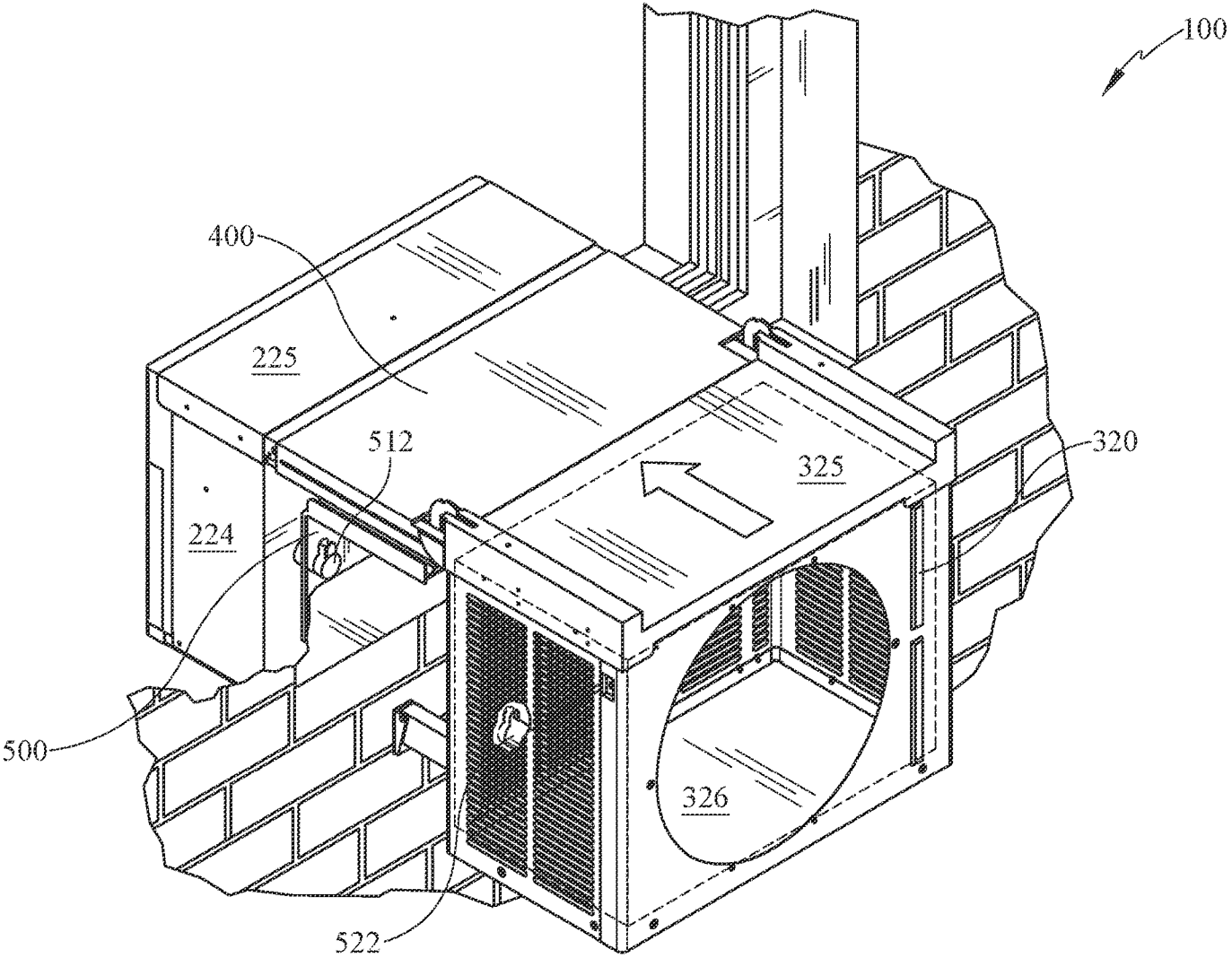
FIG. 13 is a perspective view of the air conditioner and support bracket of FIG. 11 in a third step of installation, with the outdoor portion of the air conditioner in a second orientation.

FIGS. 11-13 depict the air conditioner 100 in three states of installation. In these Figures, the support bracket 500 has already been installed in the window opening and secured thereto with the feet 511, 521. The fact that the support bracket 500 is separate from the air conditioner 100 enables a user to securely fasten the support bracket 500 into proper position about the window opening without having any of the weight of the air conditioner 100 on the support bracket 500. This provides a much easier and safer installation method than that of standard window air conditioning units, as well as saddle-type appliances that incorporate the mounting bracket into the appliance itself.

In the Figures, the support bracket 500 is in a first, contracted configuration, owing to a sill width of a certain size. However, it is to be restated that, because of the telescopical adjustability of the support bracket 500, FIGS. 11-13 could be repeated with the support bracket 500 in a second (extended) configuration. Once the support bracket 500 is properly installed about the opening (that is, adjusted in length to fit the sill or window opening), the air conditioner 100 is unpacked from its packaging, if any, and the outdoor unit 300 is either placed into, or confirmed to be in, a first rotational orientation with respect to the bridge 400, wherein the top 325 is perpendicular to the bridge 400. The air conditioner 100 is then placed onto the support bracket 500 such that the front 321 of the outdoor unit 300 rests atop the upwardly facing horizontal support bracket bridge 530. The air conditioner 100 is then moved (e.g., by sliding) along the support bracket bridge 530 towards the outside (that is, sliding through the window opening) until the indoor unit 200 contacts the first wall-facing member 510 of the support bracket 500. Then the indoor unit lock 512 is engaged to lock the indoor unit 200 into secure placement with the support bracket 500.

Next, the outdoor unit 300 is telescopically moved toward or away from the inside unit 200 by sliding the second portion 413 away from or toward the first portion 410 of the bridge 400 until the proper distance between the inside unit 200 and outside unit 300 is achieved (FIG. 12). Once the proper location is achieved (that is, the amount of telescoping of the second portion 413 with respect to the first portion 410), the user disengages rotational lock 375 and rotates the outdoor unit 300 from its first orientation downwardly to its second, installed orientation. As the outdoor unit 300 is rotating downwardly, the bias member 373 serves to prevent the outdoor unit 300 from falling too fast or slamming against the second wall-facing member 520. Once the outdoor unit 300 has rotated into its second orientation, its front 321 is brought into contact with the second wall-facing member 520 (FIG. 13). The outdoor unit 300 is then locked to the second wall-facing member 520 of the support bracket 500 by activating the outdoor unit lock 522. Once the indoor unit 200 and outdoor unit 300 are installed in their final configuration, a user can simply plug the power cord of the air conditioner 100 into a receptacle and power the appliance. The user need not make any connections of any of the line sets 420 between the indoor unit 200 and the outdoor unit 300.

Figure 14:
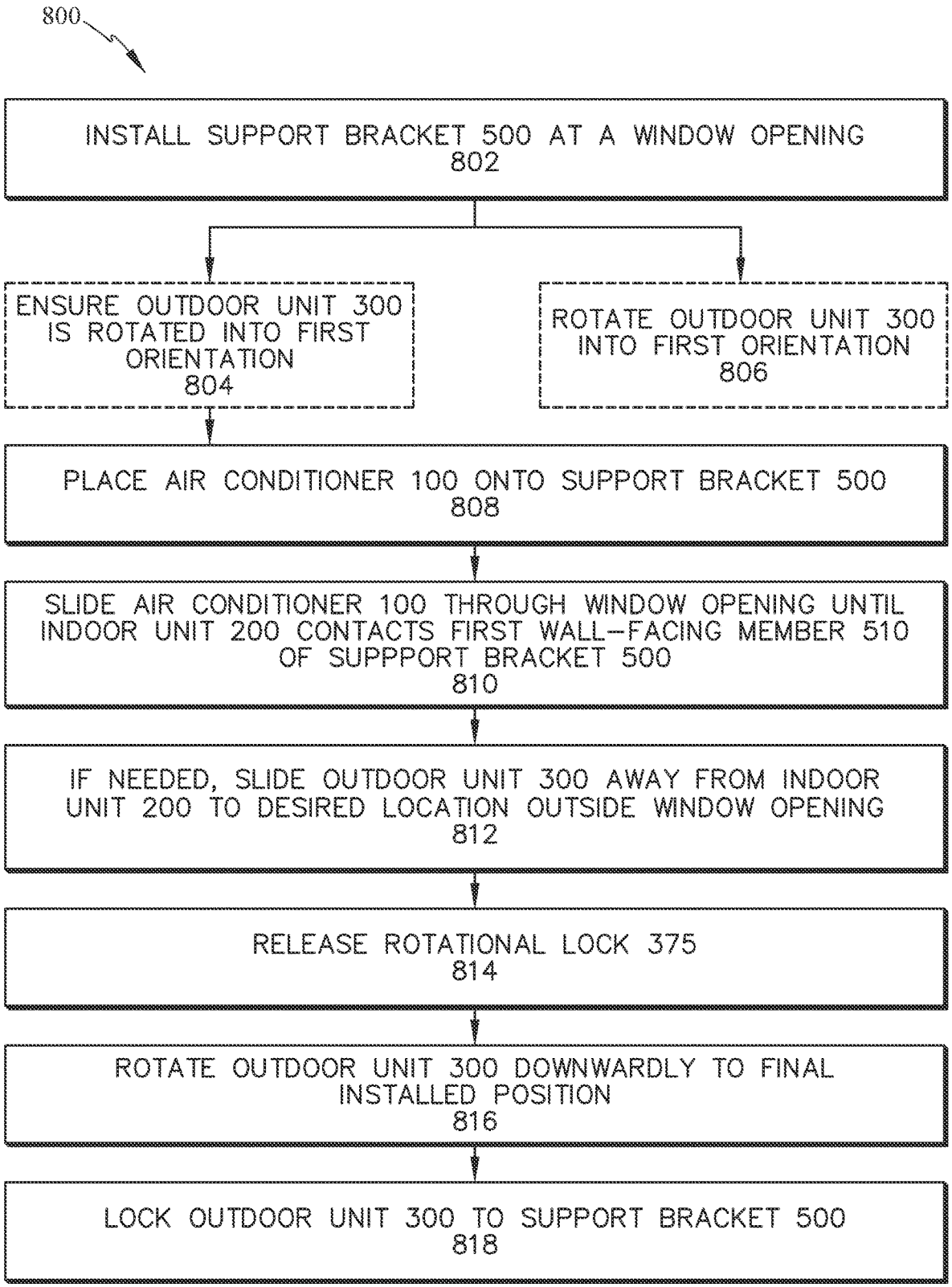
FIG. 14 is a flow diagram of an embodiment of a method of installing an air conditioner according to one embodiment.

The flow chart of FIG. 14, along with FIGS. 11-13, illustrate an example method for installing the disclosed air conditioner 100. The exemplary installation sequence 800 begins in block 802 by installing the support bracket 500 in the window opening. This step involves placing the support bracket 500 in the opening such that the first wall-facing member 510 and second wall-facing member 520 are facing down and "straddle" the opening. The support bracket 500 is adjustable in length to accommodate varying thicknesses of openings. The desired distance between first wall-facing member 510 and second wall-facing member 520 is chosen, which places each member adjacent the interior wall and exterior wall, respectively. If needed, the indoor feet 511 and the outdoor feet 521 can be arranged so as to make secure and stable contact with the wall. These feet 511, 521 can be tightened so as to provide a solid and stable support for the air conditioner 100. As mentioned previously, a very significant benefit to the design of the embodiments herein is that the support bracket 500 is not part of the air conditioner 100 itself. As a result, it is very easy and safe to install the support bracket 500, without having the weight and bulk of the air conditioner 100 on it.

Steps 804 and 806 are alternatives. After the support bracket 500 is installed, the user then begins to install the air conditioner 100. The user inspects to determine whether the outdoor unit 300 is already rotated into its first orientation, in which the top 325 is perpendicular to the bridge top cover 411. If not, the user disengages the rotational lock 375 and rotates the outdoor unit 300 into its primarily horizontal position, wherein top 325 is perpendicular to top cover 411. In this orientation, the outdoor unit 300 can fit through the window opening.

In step 808 (FIG. 11), the user places the outdoor unit 300 of air conditioner 100 onto the support bracket bridge 530 and aligns the air conditioner 100 as desired. Once aligned, in step 810 the user pushes the air conditioner 100 so that the outdoor unit 300 passes through the opening and until the indoor unit 200 contacts the first wall-facing member 520 of the support bracket 500. The user can then lock the indoor unit 200 to the support bracket 500 by engaging indoor unit lock 512.

Next, in step 812, the user can extend or retract the outdoor unit 300 as needed in order to locate it properly on the support bracket 500. This is because, as discussed previously, the bridge 400 is telescopic. Once the outdoor unit 300 is in the desired location, the user can, in step 814, release the rotational lock 375. Then, the user rotates (step 816) the outdoor unit 300 from its first position (horizontal) to its second, installed position. After that, the user can adjust the distance between the outdoor unit 300 and the indoor unit 200, if needed, such that the outdoor unit 300 contacts the second wall-facing member 520. Thereupon (step 818), the user can lock the outdoor unit 300 to the support bracket 500 by engaging the outdoor unit lock 522. Now the air conditioner 100 is fully installed, and the user simply need to plug the power cord into a proper power source to operate the air conditioner 100. Owing to the unique design, the user need not make, re-make, or adjust any connections between the indoor unit 200 and the outdoor unit 300. Rather, all functional connections remain connected as they were at purchase, and the line sets 420 can adjust in length without damage or diminished functionality.

As discussed previously, multiple embodiments of the air conditioner 100 and support bracket 500 are possible. As but one example of an alternative embodiment, the indoor unit 200 may be separated from the bridge 400 and, instead, be hung and fixed on an indoor wall, or placed elsewhere in the conditioned space, rather than being integral with the bridge 400 and outdoor unit 300. Such an indoor unit 200 can be the type of indoor unit described in co-pending application U.S. application Ser. No. 17/566,416, filed on Dec. 30, 2021, the entire contents of which are herein incorporated by reference.

The disclosed air conditioner 100 may be a variety of constructions, shapes, sizes, quantities, and positions and still accomplish the same intent. The elements depicted in the figures may not be drawn to scale and thus, the elements may have different sizes and/or configurations other than as shown in the figures.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

What is claimed is:

1. A window air conditioner, comprising:

an indoor unit configured for operation within an air-conditioned space and having an indoor unit housing and an indoor heat exchanger and a fan, all located within said indoor unit housing;

an outdoor unit configured for installation exteriorly of the air-conditioned space and having an outdoor housing and an outdoor heat exchanger, a compressor, and a fan, all located within said outdoor housing;

a bridge coupled between said indoor unit and said outdoor unit, said bridge fixedly coupled to said indoor unit and rotationally coupled to said outdoor unit, said bridge including a first portion and a second portion telescopically connected to said first portion whereby both said first portion and said indoor unit telescope relative to both said second portion and said outdoor unit, wherein said first portion and said second portion define an internal open space therebetween, wherein said internal open space houses a flexible line set, said flexible line set including refrigerant piping and electrical wiring coupled to said indoor unit and said outdoor unit such that said heat exchanger of said indoor unit is operatively connected with said compressor and said outdoor heat exchanger of said outdoor unit; said bridge further including a hinge having a first end and a second end, wherein said first end of said hinge is connected to said second portion of said bridge, and wherein said second end of said hinge is connected to said outdoor unit, whereby said outdoor unit is rotatable about an axis through said bridge from a first orientation to a second orientation, wherein said second orientation is rotated approximately 90 degrees from said first orientation; and a support bracket independent from said window air conditioner and separately installed at said window opening, said support bracket including an indoor member, an outdoor member, and a telescoping bridge portion connecting said indoor member and said outdoor member.

2. The window air conditioner of claim 1, wherein said first portion of said support bracket further comprises a first wall-facing member approximately perpendicular to, and depending downwardly from, said telescoping bridge portion of said support bracket.

3. The window air conditioner of claim 2, wherein said second portion of said support bracket further comprises a second wall-facing member approximately perpendicular to, and depending downwardly from, said telescoping bridge portion of said support bracket.

4. The window air conditioner of claim 3, wherein said indoor unit housing further comprises a front side, a rear side, a left side, a right side, a top, and a bottom.

5. The window air conditioner of claim 4, wherein said indoor unit housing depends downwardly from an extension of a top surface of said bridge.

6. The window air conditioner of claim 5, wherein said rear side of said indoor unit housing is approximately perpendicular to said first portion of said bridge.

7. The window air conditioner of claim 6, wherein said indoor unit housing further comprises an indoor unit lock for lockably coupling to said support bracket.

8. The window air conditioner of claim 7, wherein said indoor member of said support bracket further comprises one or more feet thereon for engaging contact with an interior room wall inside the air-conditioned space.

9. The window air conditioner of claim 3, wherein said outdoor unit housing further comprises a front side, a rear side, a left side, a right side, a top, and a bottom.

10. The window air conditioner of claim 9, wherein said outdoor unit housing is rotatable about said hinge through a range of orientations from a first orientation to a second orientation.

11. The window air conditioner of claim 10, wherein when said outdoor unit housing is in said first orientation, said top of said outdoor unit is approximately perpendicular to said second portion of said bridge.

12. The window air conditioner of claim 11, wherein when said outdoor unit housing is in said second orientation, said top of said outdoor unit is approximately parallel to said second portion of said bridge.

13. The window air conditioner of claim 12, wherein said outdoor unit housing further comprises an outdoor unit lock for lockably coupling to said support bracket.

14. The window air conditioner of claim 13, wherein said outdoor unit housing further comprises a rotational lock for rotatably locking said outdoor unit housing to said bridge when said outdoor unit housing is in said first orientation.

15. The window air conditioner of claim 14, wherein said outdoor member of said support bracket further comprises one or more feet thereon for engaging contact with an exterior room wall outside the air-conditioned space.

16. A window air conditioner for a window opening, comprising:

a first unit disposed inside a conditioned space;

a second unit disposed outside a conditioned space;

a bridge comprising a first portion and a second portion operatively and telescopically coupled to said first portion whereby both said first portion and said first unit telescope relative to both said second portion and said second unit; wherein said bridge telescopically extends through the window opening; wherein said first unit is fixedly coupled to said first portion of said bridge and said second unit is rotatably coupled to said second portion of said bridge; wherein said bridge further comprises an interior open space between said first portion and said second portion, which contains refrigerant piping and electrical wiring, each of which is permanently but flexibly coupled between said first unit and said second unit to flex when both said first portion and said first unit telescope relative to both said second portion and said second unit and/or when said second unit rotates relative to said second portion of said bridge; and a support bracket separate from said first unit, said second unit, and said bridge, and onto which said first unit, said second unit, and said bridge is installed.

17. The window air conditioner of claim 16, wherein said support bracket further comprises an indoor member and an outdoor member telescopically coupled to said first member.

18. The window air conditioner of claim 17, wherein said second unit is rotatable with respect to said bridge through a range of orientations from a first orientation to a second orientation.

19. The window air conditioner of claim 18, wherein in said first orientation, said outdoor unit occupies a relatively horizontal configuration to pass through the window opening.

20. A method of installing a window air conditioner, wherein said window air conditioner includes an indoor unit, an outdoor unit, and a bridge telescopically connecting said indoor unit to said outdoor unit, and wherein said outdoor unit is further rotatably coupled to said bridge enabling said outdoor unit to rotate from a first orientation to a second orientation, said method comprising:

providing a support bracket having a first wall-facing member, a bridge surface, and a second wall-facing member, said bridge telescopically coupling said first wall-facing member and said second wall-facing member;

installing said support bracket in a window opening such that said bridge resides over a sill, said first wall-facing member is coupled to an interior wall within a conditioned space, and said second wall-facing member is coupled to an exterior wall outside the conditioned space;

ensuring said outdoor unit is rotated into said first orientation with respect to said bridge;

placing said outdoor unit, said indoor unit, and said bridge of said air conditioner together on said support bracket such that said outdoor unit rests atop said bridge surface;

sliding said outdoor unit, said indoor unit and said bridge of said air conditioner together toward the exterior of the window opening until a surface of said indoor unit contacts said first wall-facing member;

locking said indoor unit to said support bracket;

rotating said outdoor unit downwardly until said outdoor unit contacts said second wall-facing member;

locking said outdoor unit to said support bracket; and connecting said air conditioner to an electrical power source.

* * * * *